US011155983B2

(12) United States Patent
Bodén et al.

(10) Patent No.: US 11,155,983 B2
(45) Date of Patent: Oct. 26, 2021

(54) REFERENCE WATER TEMPERATURE IN WATER RECIRCULATING DEVICES

(71) Applicant: ORBITAL SYSTEMS AB, Malmö (SE)

(72) Inventors: Richard Bodén, Malmö (SE); Michael Ridell, Staffanstorp (SE)

(73) Assignee: ORBITAL SYSTEMS AB, Malmö (SE)

( * ) Notice: Subject to any disclaimer, the term of this patent is extended or adjusted under 35 U.S.C. 154(b) by 0 days.

(21) Appl. No.: 16/494,343

(22) PCT Filed: Mar. 12, 2018

(86) PCT No.: PCT/SE2018/050232
§ 371 (c)(1),
(2) Date: Sep. 16, 2019

(87) PCT Pub. No.: WO2018/169472
PCT Pub. Date: Sep. 20, 2018

(65) Prior Publication Data

US 2020/0299936 A1 Sep. 24, 2020

(30) Foreign Application Priority Data

Mar. 15, 2017 (SE) ..... 1750304-6

(51) Int. Cl.
*E03B 1/04* (2006.01)

(52) U.S. Cl.
CPC ..... *E03B 1/041* (2013.01); *E03B 1/044* (2013.01); *E03B 2001/045* (2013.01)

(58) Field of Classification Search
CPC .... E03B 1/041; E03B 1/044; E03B 2001/045; E03B 1/00; E03B 1/04; E03C 1/1222
See application file for complete search history.

(56) References Cited

U.S. PATENT DOCUMENTS 4,893,364 A * 1/1990 Keeler ..... E03C 1/00 137/393
5,206,963 A * 5/1993 Wiens ..... E03C 1/00 4/597

(Continued)

OTHER PUBLICATIONS

International Search Report on application No. PCT/SE2018/050232 dated May 11, 2018.

(Continued)

*Primary Examiner* — J C Jacyna
(74) *Attorney, Agent, or Firm* — Moser Taboada

(57) ABSTRACT

The present inventive concept relates to a system (100) comprising: a water recirculating device comprising: a heating arrangement (112) arranged in a recirculating path (108); a mixing valve arrangement (122) in liquid communication with an external ON water path arrangement (114), said mixing valve arrangement (122) accepting as inputs hot and cold water from a hot and cold water source respectively, said mixing valve arrangement (122) being configured to form temperature regulated water (120) by combining said hot and cold water, said mixing valve arrangement (122) comprising a user input interface configured to control a proportion of said hot and cold water directed to said external water path arrangement (114); and a reference temperature determining arrangement (130) configured to determine a reference water temperature of said temperature regulated water (120); wherein said heating arrangement (112) is configured to adjust a water temperature of treated water towards said reference water temperature.

16 Claims, 1 Drawing Sheet

(56) References Cited

U.S. PATENT DOCUMENTS

| | | | | |
|---|---|---|---|---|
| 5,293,654 | A * | 3/1994 | Castwall | E03C 1/00 4/597 |
| 6,286,764 | B1 | 9/2001 | Garvey et al. | |
| 6,481,028 | B1 | 11/2002 | Hsia | |
| 2008/0196156 | A1 | 8/2008 | Brewin | |
| 2011/0146800 | A1* | 6/2011 | Jallon | E03C 1/00 137/1 |
| 2011/0289672 | A1 | 12/2011 | Cummings | |
| 2016/0319522 | A1 | 11/2016 | Sparre et al. | |
| 2018/0022618 | A1* | 1/2018 | Bertrand | C02F 1/008 210/103 |
| 2019/0003158 | A1* | 1/2019 | De Jong | E03C 1/0408 |
| 2020/0318323 | A1* | 10/2020 | Pendlebury | E03B 1/041 |

OTHER PUBLICATIONS

European Patent Office Communication for Application No. 18768600.1, dated Jul. 24, 2019.

* cited by examiner

REFERENCE WATER TEMPERATURE IN WATER RECIRCULATING DEVICES

TECHNICAL FIELD

The inventive concept described herein generally relates to the field of water recirculation. More particularly, concepts for improved control of water temperature in water recirculating devices are disclosed.

BACKGROUND

In many parts of the world, water is becoming a scarce commodity. Consequently, systems for purification and recycling of water has found applications across many fields. Conventional water recycling devices can be effective, but are often costly, and requires frequent maintenance and major modifications to existing water infrastructure. There is therefore a need for improved water recirculating devices in terms of cost effectiveness, ease of installation and use, and customizability.

SUMMARY OF THE INVENTION

It is an object of the present inventive concept to mitigate, alleviate or eliminate one or more of the above-identified deficiencies in the art and disadvantages singly or in combination.

According to a first aspect of the inventive concept, these and other objects are achieved in full, or at least in part, by a system comprising: a water recirculating device comprising: an outlet configured to output treated water; a drain for collecting used water output from the outlet; a recirculating path in liquid communication with the drain and the outlet; a water treatment arrangement arranged in the recirculating path; a heating arrangement arranged in the recirculating path; an external water path arrangement in liquid communication with the recirculating path; and a valve arrangement configured to accept as inputs used water from the drain and/or temperature regulated water from the external water path arrangement, the valve arrangement being configured to direct the inputs towards the outlet and to mix the temperature regulated water with the used water from the drain; a mixing valve arrangement in liquid communication with the external water path arrangement, the mixing valve arrangement accepting as inputs hot and cold water from a hot and cold water source respectively, the mixing valve arrangement being configured to form the temperature regulated water by combining the hot and cold water, the mixing valve arrangement comprising a user input interface configured to control a proportion of the hot and cold water directed to the external water path arrangement; and a reference temperature determining arrangement configured to determine a reference water temperature of the temperature regulated water; wherein the heating arrangement is configured to adjust a water temperature of the treated water towards the reference water temperature.

The valve arrangement may be configured to accept as inputs at least one of used water from the drain and temperature regulated water from the external water path arrangement, and the valve arrangement may further be configured to direct the inputs towards the outlet and to mix the temperature regulated water with the used water from the drain.

Water having been treated by the water treatment arrangement may be referred to as 'treated water' throughout the present disclosure.

As is readily understood by the person skilled in the art, adjusting a water temperature of the treated water, i.e. water in the water treatment arrangement or water downstream of the water treatment arrangement, towards the reference water temperature, does not necessarily imply that the treated water assumes the exact same temperature as the reference water temperature. Further, any heat lost or added from the point of the heating arrangement to the point of the outlet where the treated water is output may preferably be taken into account in order to accurately adjust the temperature of the treated water towards the reference water temperature.

The reference temperature determining arrangement may comprise a first water temperature sensor arranged in the external water path arrangement.

The reference temperature determining arrangement may comprise a second water temperature sensor arranged downstream of the valve arrangement, a third water temperature sensor arranged upstream of the valve arrangement, and wherein the reference temperature determining arrangement is configured to determine a proportion of used water from the drain and temperature regulated water from the external water path arrangement input to the valve arrangement.

The water recirculating device may be configured to discard at least part of the used water via a drain discard path if the used water is below a quality threshold.

The system may be configured to be in a first state wherein a reference flow of the temperature regulated water is allowed to enter the valve arrangement, and a second state wherein a refill flow of the temperature regulated water is allowed to enter the valve arrangement in response to the used water being below the quality threshold.

The refill flow may be higher than the reference flow.

The external water path arrangement may comprise a reference flow path configured to direct the reference flow from the mixing valve arrangement to the valve arrangement, and a refill flow path configured to direct the refill flow from the mixing valve arrangement to the valve arrangement.

The reference flow may be provided at pre-determined time intervals

The mixing valve arrangement may be a mechanical thermostatic mixing valve.

The mixing valve arrangement may comprise a mechanical thermostatic mixing valve.

The device may be a recirculating shower.

According to a second aspect of the inventive concept, these and other objects are achieved in full, or at least in part, by a method for adjusting a temperature of water output by a system comprising: a water recirculating device comprising: an outlet configured to output treated water; a drain for collecting used water output from the outlet; a recirculating path in liquid communication with the drain and the outlet; a water treatment arrangement arranged in the recirculating path; a heating arrangement arranged in the recirculating path; an external water path arrangement in liquid communication with the recirculating path; and a valve arrangement configured to accept as inputs used water from the drain and/or temperature regulated water from the external water path arrangement, the valve arrangement being configured to direct the inputs towards the outlet and to mix the temperature regulated water with the used water from the drain; a mixing valve arrangement in liquid communication with the external water path arrangement, the mixing valve arrangement accepting as inputs hot and cold water from a hot and cold water source respectively, the mixing valve arrangement being configured to form the temperature regulated water by combining the hot and cold water, the mixing valve arrangement comprising a user input interface configured to control a proportion of the hot and cold water directed to the external water path arrangement; and a reference temperature determining arrangement configured to determine a reference water temperature of the temperature regulated water; wherein the heating arrangement is configured to adjust a water temperature of the treated water towards the reference water temperature, wherein the method comprises the steps of: providing temperature regulated water from the mixing valve arrangement to the valve arrangement; determining a reference water temperature of the temperature regulated water; and adjusting the heating arrangement such that a water temperature of the treated water is adjusted towards the reference water temperature.

The reference temperature determining arrangement may comprise a water temperature sensor arranged in the external water path arrangement, and wherein the step of determining a reference water temperature of the temperature regulated water comprises determining a reference water temperature of the temperature regulated water using the water temperature sensor.

The reference temperature determining arrangement may comprise a second water temperature sensor arranged downstream of the valve arrangement, and a third water temperature sensor arranged upstream of the valve arrangement, wherein the method further comprises the steps of: determining a first water temperature of water upstream of the valve arrangement using the second water temperature sensor; determining a second water temperature of water downstream of the valve arrangement using the third water temperature sensor; determining a proportion of used water from the drain and temperature regulated water from the external water path arrangement input to the valve arrangement using the reference temperature determining arrangement; and determining the reference water temperature using the first water temperature, the second water temperature, and the proportion of used water from the drain and temperature regulated water from the external water path arrangement input to the valve arrangement.

The water recirculating device may be configured to discard at least part of the used water via a drain discard path if the used water is below a quality threshold.

The system may be configured to be in a first state and a second state, wherein the method further comprises the steps of: when the system is in the first state, providing a reference flow of the temperature regulated water from the mixing valve arrangement to the valve arrangement; and when the system is in the second state, providing a refill flow of the temperature regulated water from the mixing valve arrangement to the valve arrangement in response to the used water being below the quality threshold.

The refill flow may be higher than the reference flow.

The refill flow may be substantially lower than a flow of water in the recirculating path. The reference flow may be substantially lower than a flow of water in the recirculating path. The refill flow may be lower than a flow of water in the recirculating path. The reference flow may be lower than a flow of water in the recirculating path.

The external water path arrangement may comprise a reference flow path configured to direct the reference flow from the mixing valve arrangement to the valve arrangement, and a refill flow path configured to direct the refill flow from the mixing valve arrangement to the valve arrangement, wherein the method further comprises the steps of: providing the reference flow in the reference flow path; and providing the refill flow in the refill flow path.

The reference flow may be provided at pre-determined time intervals.

The mixing valve arrangement may be a mechanical thermostatic mixing valve.

The mixing valve arrangement may comprise a mechanical thermostatic mixing valve.

According to a third aspect of the inventive concept, these and other objects are achieved in full, or at least in part, by a system comprising: a water recirculating device comprising: an outlet configured to output treated water; a drain for collecting used water output from the outlet; a recirculating path in liquid communication with the drain and the outlet; a water treatment arrangement arranged in the recirculating path; an external water path arrangement in liquid communication with the recirculating path; and a valve arrangement configured to accept as inputs used water from the drain and/or temperature regulated water from the external water path arrangement, the valve arrangement being configured to direct the inputs towards the outlet and to mix the temperature regulated water with the used water from the drain; a mixing valve arrangement in liquid communication with the external water path arrangement, the mixing valve arrangement accepting as inputs hot and cold water from a hot and cold water source respectively, the mixing valve arrangement being configured to form the temperature regulated water by combining the hot and cold water, the mixing valve arrangement comprising a user input interface configured to control a proportion of the hot and cold water directed to the external water path arrangement; and a reference flow rate determining arrangement configured to determine a reference flow rate of the temperature regulated water; wherein the device is configured to adjust a flow rate of the treated water output by the outlet towards the reference flow rate.

A feature described in relation to one aspect may also be incorporated in other aspects, and the advantage of the feature is applicable to all aspects in which it is incorporated.

Other objectives, features and advantages of the present inventive concept will appear from the following detailed disclosure, from the attached claims as well as from the drawings.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present inventive concept, will be better understood through the following illustrative and non-limiting detailed description of different embodiments of the present inventive concept, with reference to the appended drawings, wherein.

DETAILED DESCRIPTION

The present disclosure relates to water recirculating devices. Initially, some terminology may be defined to provide clarification for the following disclosure.

Throughout the present disclosure, references are made to "hot water" and "cold water". Hot water may refer to water having a higher temperature than cold water. Cold water may refer to water having a lower temperature than hot water. It is to be understood that the quality of hot and cold water with respect to temperature and contaminants may vary between applications of the water recirculating device, and between different countries wherein the water recirculating device is located.

Throughout the present disclosure, reference is made to "treated water" as well as "used water". Treated water may be water which has passed a water treatment arrangement. Treated water which leaves an outlet of the water recycling device may be referred to as used water.

Throughout the present disclosure, reference is made to different paths. Such paths may be for example pipes for transporting water.

Throughout the present disclosure, references are made to features being arranged "downstream" and/or "upstream" of certain features. The flow direction to which the terms "downstream" and "upstream" refer should be understood to be a flow direction from the drain to the outlet. In other words, the "stream" referred to in the terms "downstream" and "upstream" is a stream flowing from the drain to the outlet.

In general, the inventive concept is based on the realization that a reference temperature can be determined from a mixing valve arrangement and that the reference temperature can be used to adjust a water temperature of water in a recirculating device towards the reference temperature. A consequence of this arrangement is that the user input interface of a regular mixing valve arrangement can be used to control the output water temperature of a water recirculating device. Similarly, a reference flow rate may be determined, and a flow rate of treated water output by the water recirculating device can be adjusted towards the reference flow rate.

Figure 1:
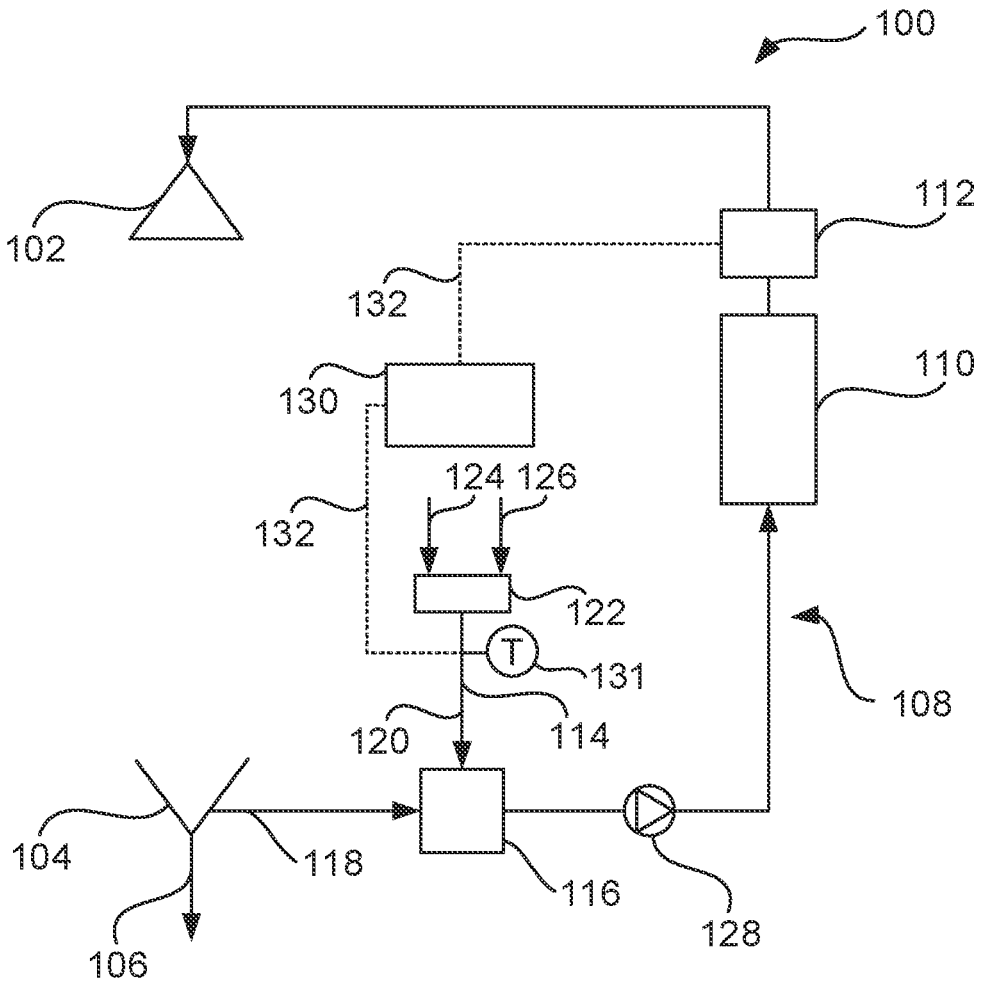
FIG. 1 schematically illustrates a system according to the inventive concept.

With reference to FIG. 1 and according to the inventive concept, a system 100 may comprise a water recirculating device comprising: an outlet 102 configured to output treated water; a drain 104 for collecting used water output from the outlet 102; a recirculating path 108 in liquid communication with the drain 104 and the outlet 102; a water treatment arrangement 110 arranged in the recirculating path 108; a heating arrangement 112 arranged in the recirculating path 108; an external water path arrangement 114 in liquid communication with the recirculating path 108; and a valve arrangement 116 configured to accept as inputs used water 118 from the drain 104 and/or temperature regulated water 120 from the external water path arrangement 114, the valve arrangement 116 being configured to direct the inputs towards the outlet 102 and to mix the temperature regulated water 120 with the used water 118 from the drain; a mixing valve arrangement 122 in liquid communication with the external water path arrangement 114, the mixing valve arrangement 122 accepting as inputs hot and cold water from a hot and cold water source respectively, the mixing valve arrangement 122 being configured to form the temperature regulated water by combining the hot and cold water, the mixing valve arrangement 122 comprising a user input interface configured to control a proportion of the hot and cold water directed to the external water path arrangement 114; and a reference temperature determining arrangement 130 configured to determine a reference water temperature 132 of the temperature regulated water 120; wherein the heating arrangement 112 is configured to adjust a water temperature of the treated water towards the reference water temperature 132.

The hot and cold water may be provided to the mixing valve arrangement via a hot and cold water path 124, 126 respectively.

The water recirculating device may comprise a circulation pump 128 for providing a flow of water in the water recirculating device.

For the sake of clarity, the reference temperature determining arrangement 130 is illustrated as a separate element in FIG. 1. However, the reference temperature determining arrangement 130 is not limited to being confined in a single element. Further, the reference temperature determining arrangement 130 may comprise a number of components arranged at various locations of the system.

The reference temperature determining arrangement 130 may comprise a first water temperature sensor 131 arranged in the external water path arrangement 114.

The reference temperature determining arrangement may comprise a second water temperature sensor arranged downstream of the valve arrangement 116, and a third water temperature sensor arranged upstream of the valve arrangement 116, and the reference temperature determining arrangement 130 may be configured to determine a proportion of used water 118 from the drain 104 and temperature regulated water 120 from the external water path arrangement 114 input to the valve arrangement 116. Hereby, the reference water temperature 132 may be determined. For example, if a temperature of used water 118 upstream of the valve arrangement 116 is known, and a temperature of water downstream of the valve arrangement 116 is known, and the proportion of used water 118 and temperature regulated water 120 input to the valve arrangement 116 is known, a temperature of the temperature regulated water, i.e. the reference water temperature 132, can be determined.

The water recirculating device may be configured to discard at least part of the used water via a drain discard path 106 if the used water is below a quality threshold. A quality of the used water may be determined in the drain by a sensor arrangement configured to determine a water quality. The sensor arrangement configured to determine a water quality may comprise an electrical conductivity sensor. The sensor arrangement configured to determine a water quality may comprise a pH sensor. The sensor arrangement configured to determine a water quality may comprise a turbidity sensor.

The system may be configured to be in a first state wherein a reference flow of the temperature regulated water 120 is allowed to enter the valve arrangement 116, and a second state wherein a refill flow of the temperature regulated water 120 is allowed to enter the valve arrangement 116 in response to the used water being below the quality threshold. The refill flow may be higher than the reference flow. Hereby, if used water is discarded from the water recirculating device via the discharge path 106, a refill flow of temperature regulated water 120 may provide for that a flow rate of treated water output by the outlet 102 is kept substantially constant.

The external water path arrangement 114 may comprise a reference flow path configured to direct the reference flow from the mixing valve 122 to the valve arrangement 116, and a refill flow path configured to direct the refill flow from the mixing valve 122 to the valve arrangement 116.

The reference flow may be provided at pre-determined time intervals. In other words, the reference flow of temperature regulated water 120 does not necessarily have to be provided continuously. An intermittent reference flow may be sufficient to determine a reference water temperature, such that the heating arrangement can adjust a water temperature of the treated water towards the reference water temperature.

The mixing valve may be a mechanical thermostatic mixing valve.

According to the inventive concept, a method for adjusting a temperature of water output by a system as disclosed in the sections above may comprise the steps of: providing temperature regulated water from the mixing valve to the valve arrangement; determining a reference water temperature of the temperature regulated water; and adjusting the heating arrangement such that a water temperature of the treated water is adjusted towards the reference water temperature.

According to the inventive concept, and similarly to how a reference water temperature can be determined by providing a flow of temperature regulated water from the mixing valve to the valve arrangement, a reference flow rate can be determined. The system may comprise a reference flow rate determining arrangement configured to determine a reference flow rate of water from the mixing valve arrangement input to the valve arrangement. Based on the reference flow rate, the device may be adjusted such that a flow rate of treated water output by the outlet is adjusted towards the reference flow rate. For example, the circulation pump may be adjusted such that a flow rate of treated water output by the outlet is adjusted towards the reference flow rate, and/or the valve arrangement 116 may be adjusted such that a flow rate of treated water output by the outlet is adjusted towards the reference flow rate. It is to be understood that the reference flow rate determining arrangement does not necessarily have to detect a flow rate. For example, the reference flow rate determining arrangement may detect a pressure in a water path of the water recirculating device, such that the reference flow rate can be deduced.

Figure 2:
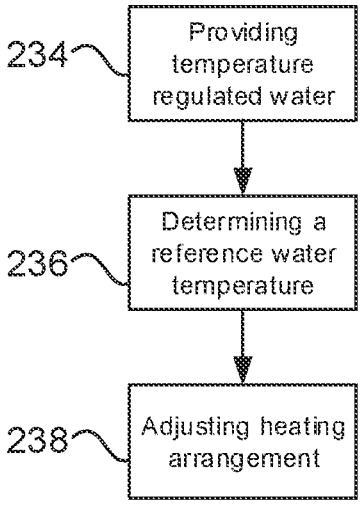
FIG. 2 is a flow chart diagram of a method for adjusting a temperature of water output by a system.

Referring now to FIG. 2, a method for adjusting a temperature of water output by a system comprising: a water recirculating device comprising: an outlet configured to output treated water; a drain for collecting used water output from said outlet; a recirculating path in liquid communication with said drain and said outlet; a water treatment arrangement arranged in said recirculating path; a heating arrangement arranged in said recirculating path; an external water path arrangement in liquid communication with said recirculating path; and a valve arrangement configured to accept as inputs used water from said drain and/or temperature regulated water from said external water path arrangement, said valve arrangement being configured to direct said inputs towards said outlet and to mix said temperature regulated water with said used water from said drain; a mixing valve arrangement in liquid communication with said external water path arrangement, said mixing valve arrangement accepting as inputs hot and cold water from a hot and cold water source respectively, said mixing valve arrangement being configured to form said temperature regulated water by combining said hot and cold water, said mixing valve arrangement comprising a user input interface configured to control a proportion of said hot and cold water directed to said external water path arrangement; and a reference temperature determining arrangement configured to determine a reference water temperature of said temperature regulated water; wherein said heating arrangement is configured to adjust a water temperature of said treated water towards said reference water temperature, may comprise the steps of providing temperature regulated water 234 from said mixing valve to said valve arrangement; determining a reference water temperature 236 of said temperature regulated water; and adjusting said heating arrangement 238 such that a water temperature of said treated water is adjusted towards said reference water temperature.

The inventive concept has mainly been described above with reference to a few embodiments. However, as is readily appreciated by a person skilled in the art, other embodiments than the ones disclosed above are equally possible within the scope of the inventive concept, as defined by the appended patent claims.

LIST OF REFERENCE SIGNS

100 System
102 Outlet
104 Drain
106 Discharge path
108 Recirculating path
110 Water treatment arrangement
112 Heating arrangement
114 External water path arrangement
116 Valve arrangement
118 Used water
120 Temperature regulated water
122 Mixing valve
124 Hot water path
126 Cold water path
128 Circulation pump
130 Reference temperature determining arrangement
132 Reference water temperature
234 Step of providing temperature regulated water
236 Step of determining a reference water temperature
238 Step of adjusting heating arrangement

The invention claimed is:

1. A system comprising:

a water recirculating device comprising:

an outlet configured to output treated water;

a drain for collecting used water output from said outlet;

a recirculating path in liquid communication with said drain and said outlet;

a water treatment arrangement arranged in said recirculating path, to output said treated water;

a heating arrangement arranged in said recirculating path;

an external water path arrangement in liquid communication with said recirculating path; and a valve arrangement configured to accept as inputs used water from said drain and/or temperature regulated water from said external water path arrangement, said valve arrangement being configured to direct said inputs towards said outlet, and to mix said temperature regulated water with said used water from said drain when both said temperature regulated water and said used water are received as inputs to the valve arrangement;

a mixing valve arrangement in liquid communication with said external water path arrangement, said mixing valve arrangement accepting as inputs hot and cold water from a hot and cold water source respectively, said mixing valve arrangement being configured to form said temperature regulated water by combining said hot and cold water, said mixing valve arrangement comprising a user input interface configured to control a proportion of said hot and cold water directed to said external water path arrangement; and a reference temperature determining arrangement configured to determine a reference water temperature of said temperature regulated water, wherein said heating arrangement is configured to adjust a water temperature of said treated water towards said reference water temperature.

2. The system according to claim 1, wherein said reference temperature determining arrangement comprises a first water temperature sensor arranged in said external water path arrangement.

3. The system according to claim 1, wherein said system is configured to be in a first state wherein a reference flow of said temperature regulated water is allowed to enter said valve arrangement, and a second state wherein a refill flow of said temperature regulated water is allowed to enter said valve arrangement in response to said used water being below a quality threshold.

4. The system according to claim 3, wherein said refill flow is higher than said reference flow.

5. The system according to claim 3, wherein said external water path arrangement comprises a reference flow path configured to direct said reference flow from said mixing valve arrangement to said valve arrangement, and a refill flow path configured to direct said refill flow from said mixing valve arrangement to said valve arrangement.

6. A system comprising:

a water recirculating device comprising:

an outlet configured to output treated water;

a drain for collecting used water output from said outlet;

a recirculating path in liquid communication with said drain and said outlet;

a water treatment arrangement arranged in said recirculating path;

a heating arrangement arranged in said recirculating path;

an external water path arrangement in liquid communication with said recirculating path; and a valve arrangement configured to accept as inputs used water from said drain and/or temperature regulated water from said external water path arrangement, said valve arrangement being configured to direct said inputs towards said outlet, and to mix said temperature regulated water with said used water from said drain when both said temperature regulated water and said used water are received as inputs to the valve arrangement;

a mixing valve arrangement in liquid communication with said external water path arrangement, said mixing valve arrangement accepting as inputs hot and cold water from a hot and cold water source respectively, said mixing valve arrangement being configured to form said temperature regulated water by combining said hot and cold water, said mixing valve arrangement comprising a user input interface configured to control a proportion of said hot and cold water directed to said external water path arrangement; and a reference temperature determining arrangement configured to determine a reference water temperature of said temperature regulated water, wherein said heating arrangement is configured to adjust a water temperature of said treated water towards said reference water temperature, wherein said system is configured to be in a first state wherein a reference flow of said temperature regulated water is allowed to enter said valve arrangement, and a second state wherein a refill flow of said temperature regulated water is allowed to enter said valve arrangement in response to said used water being below a quality threshold, and wherein said reference flow is provided at pre-determined time intervals.

7. The system according to claim 1, wherein said mixing valve arrangement is a mechanical thermostatic mixing valve.

8. A method for adjusting a temperature of water output by a system comprising:

a water recirculating device comprising:

an outlet configured to output treated water;

a drain for collecting used water output from said outlet;

a recirculating path in liquid communication with said drain and said outlet;

a water treatment arrangement arranged in said recirculating path, to output said treated water;

a heating arrangement arranged in said recirculating path;

an external water path arrangement in liquid communication with said recirculating path; and a valve arrangement configured to accept as inputs used water from said drain and/or temperature regulated water from said external water path arrangement, said valve arrangement being configured to direct said inputs towards said outlet and to mix said temperature regulated water with said used water from said drain when both said temperature regulated water and said used water are received as inputs to the valve arrangement;

a mixing valve arrangement in liquid communication with said external water path arrangement, said mixing valve arrangement accepting as inputs hot and cold water from a hot and cold water source respectively, said mixing valve arrangement being configured to form said temperature regulated water by combining said hot and cold water, said mixing valve arrangement comprising a user input interface configured to control a proportion of said hot and cold water directed to said external water path arrangement; and a reference temperature determining arrangement configured to determine a reference water temperature of said temperature regulated water;

wherein said heating arrangement is configured to adjust a water temperature of said treated water towards said reference water temperature, wherein said method comprises the steps of:

providing temperature regulated water from said mixing valve arrangement to said valve arrangement;

determining a reference water temperature of said temperature regulated water; and adjusting said heating arrangement such that a water temperature of said treated water is adjusted towards said reference water temperature.

9. The method according to claim 8, wherein said system is configured to be in a first state and a second state, wherein said method further comprises the steps of:

when said system is in said first state, providing a reference flow of said temperature regulated water from said mixing valve arrangement to said valve arrangement; and when said system is in said second state, providing a refill flow of said temperature regulated water from said mixing valve arrangement to said valve arrangement in response to said used water being below said a quality threshold.

10. The method according to claim 8, wherein said external water path arrangement comprises a reference flow path configured to direct said reference flow from said mixing valve arrangement to said valve arrangement, and a refill flow path configured to direct said refill flow from said mixing valve arrangement to said valve arrangement, wherein said method further comprises the steps of:

providing said reference flow in said reference flow path; and providing said refill flow in said refill flow path.

11. The method according to claim 8, wherein said reference temperature determining arrangement comprises a first water temperature sensor arranged in said external water path arrangement.

12. The method according to claim 8, wherein said system is configured to be in a first state wherein a reference flow of said temperature regulated water is allowed to enter said valve arrangement, and a second state wherein a refill flow of said temperature regulated water is allowed to enter said valve arrangement in response to said used water being below a quality threshold.

13. The method according to claim 8, further comprising adjusting, by the water recirculating device, a flow rate of treated water output towards a reference flow rate.

14. The method according to claim 10, further comprising adjusting, by the water recirculating device, a flow rate of treated water output towards a reference flow rate.

15. The system according to claim 1, wherein a flow rate of treated water output by the water recirculating device is adjusted towards a reference flow rate.

16. The system according to claim 5, wherein a flow rate of treated water output by the water recirculating device is adjusted towards a reference flow rate.

* * * * *